US005535646A

United States Patent [19]

Allen et al.

[11] Patent Number: 5,535,646

[45] Date of Patent: Jul. 16, 1996

[54] RATCHET DRIVE

[75] Inventors: Kenneth D. Allen, Spring Valley, Ohio; Edward R. Neff, Defiance, Mo.

[73] Assignee: Stanley Mechanics Tools, Inc., New Britain, Conn.

[21] Appl. No.: 385,044

[22] Filed: Feb. 7, 1995

[51] Int. Cl.[6] ..... B25B 13/46

[52] U.S. Cl. ..... 81/57.39; 81/63.1

[58] Field of Search ..... 81/57.39, 61, 62, 81/63.1

[56] References Cited

U.S. PATENT DOCUMENTS

| | | |
|---|---|---|
| 2,712,256 | 7/1955 | Fish . |
| 2,758,569 | 8/1956 | Peterson . |
| 4,091,890 | 5/1978 | Wilmeth et al. . |
| 4,200,011 | 4/1980 | Wilmeth . |
| 4,346,630 | 8/1982 | Hanson . |
| 4,372,181 | 2/1983 | Tinsley . |
| 4,440,046 | 4/1984 | Hirtsiefer et al. . |
| 4,480,510 | 11/1984 | Aparicio, Jr. et al. . |
| 4,722,252 | 2/1988 | Fulcher et al. . |
| 4,993,288 | 2/1991 | Anderson et al. . |
| 5,142,952 | 9/1992 | Putney et al. . |

*Primary Examiner*—James G. Smith
*Attorney, Agent, or Firm*—Kalish & Gilster

[57] ABSTRACT

A ratchet drive mechanism is substantially completely enclosed within the housing of a hand tool. The ratchet drive mechanism includes a drive link having forwardly and rearwardly disposed ends within the tool housing. The drive link is adapted to engage a movement-imparting element of the hand tool and to movably engage at least one pawl. The at least one pawl has two ends and extends continuously therebetween, and an angle substantially centrally along the length thereof to form an elbow at which the at least one pawl is movably connected to one end of the drive link. The ratchet drive mechanism also has a drive gear with a drive shaft extending axially therefrom. The drive gear is mounted within a forward end of the housing of the hand tool with the drive shaft disposed transversely relative to a longitudinal axis of the hand tool and extending beyond the confines of the tool housing for interengagement of an item to be turned.

18 Claims, 4 Drawing Sheets

RATCHET DRIVE

BACKGROUND AND SUMMARY OF THE INVENTION

The present invention relates generally to the field of ratchet drives for hand tools, and, more specifically, to an enclosed, bidirectional ratchet drive mechanism for a high-speed power hand tool, particularly such a tool of the pneumatic type.

Previously known ratcheting mechanisms for power hand tools have been mounted on the exterior of one end of a tool body in a manner which required the moving parts of the ratchet to be exposed. With the tool so constructed, dirt and debris, such as grease and metallic filings, could enter the ratchet mechanism and increase the rate at which the various parts of the device would wear down. As the parts became worn the intermeshing portions would slip and eventually the tool had to be rebuilt or discarded. The new ratchet drive mechanism described hereafter is incorporated into a power tool in a compact and almost entirely enclosed manner so that such wear due to debris does not occur. The only portions extending from the tool housing in the present ratchet drive are the drive shaft and reverse control lever.

Other known ratchet mechanisms are useful for turning a part only in one direction. Thus any particular job may require two separate tools for alternatively rotating a part clockwise or counterclockwise. The mechanism of the present invention overcomes this problem by permitting bidirectional ratcheting with a single tool. Furthermore, this bidirectional ratcheting mechanism is incorporated into the housing of a standard size tool, so that no extra bulk is involved to complicate or otherwise impair performing a particular job. Furthermore, this change in tool operational direction can be accomplished with only one hand (indeed with only one finger) while the tool motor is running at speeds up to those in the general range of 20,000 to 25,000 rpm, enabling the user to reverse direction without removing the tool from the fastener, thus greatly increasing user efficiency.

A further drawback of some known ratcheting tools is inherent weakness and a high rate of tool breakdown due to breakage of the teeth of the ratchet drive. This is often caused by a pawl of the mechanism having only one tooth engaging a single tooth of the drive gear at any one time. Such breakage necessarily leads to a high rate of lost work hours and other costs associated with tool repair and replacement.

The present ratchet drive mechanism overcomes this historical problem by incorporating a greater number of engaging teeth, to increase the surface area carrying the turning force. Also, a drive angle is created by positioning the toothed pawl surfaces tangentially relative to the gear, which causes a positive mesh in the output gear so that the intermeshing pawls and output gear have a tendency to dig in and stay in tight mesh when driving. By thus avoiding slippage, wear of the parts is greatly reduced.

The new ratchet mechanism is entirely different from known arrangements in using oppositely-disposed, spring-biased drive pawls which have inner portions pivotally connected to a yoke shaped drive link which is driven in conventional manner by a crank having a cylindrical surface.

The driving arrangement is stronger in the new ratchet device because the thrust is carried along the length of the drive pawls, and greater numbers of teeth are in engagement at any given time. The driving relationship is such that two teeth are advanced per revolution of the drive motor shaft. This arrangement enhances drive speed without compromising torque and the output shaft can be driven at higher speeds (up to or greater than 200 rpm) than in prior constructions.

Accordingly, it is among the goals of the present invention to provide an enclosed, bidirectionally operable ratchet drive for a hand tool of the power type which ratchet drive is reasonably inexpensive to manufacture and is extremely facile to operate by anyone with even limited experience in use of power tools.

It is further among the goals of the present invention, having the features indicated, that the new ratchet drive be compact and structured so as to be capable of being incorporated within the housing of a power tool, such as a pneumatic hand tool of known size and shape, for most convenient and familiar use, and which ratchet mechanism is constructed so as to provide exceptional wear and longevity of its parts so as to lead to decreased costs associated with use of the ratcheting power tool in which the mechanism is incorporated.

Accordingly, in keeping with the above-mentioned goals, the present invention is, briefly, a ratchet drive mechanism substantially completely enclosed within the housing of a hand tool. The ratchet drive mechanism includes a drive link having a first end and a second end, the first end being disposed rearwardly within the tool housing and being adapted to engage a movement-imparting element of the hand tool and the second end being disposed forwardly within the tool housing and being adapted to movably engage at least one pawl. The at least one pawl has a first end and a second end and extends continuously therebetween and has an angle substantially centrally along the length thereof to form an elbow. The at least one pawl is movably connected to the second end of the drive link at the elbow of the at least one pawl. The mechanism also includes a drive gear with a drive shaft extending axially therefrom. The drive gear is mounted within a forward end of the housing of the hand tool with the drive shaft disposed transversely relative to a longitudinal axis of the hand tool and extending beyond the confines of the tool housing for interengagement of an item to be turned.

Other goals and advantages of the invention will be in part apparent and in part pointed out hereinbelow.

BRIEF DESCRIPTION OF THE DRAWINGS

Throughout the drawings like parts are indicated by like element numbers.

DESCRIPTION OF THE PREFERRED EMBODIMENT

Figure 8:
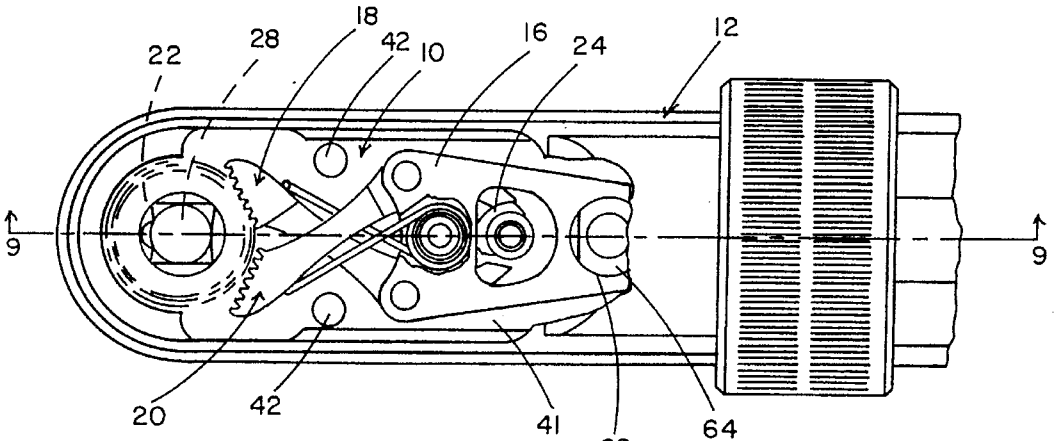
FIG. 8 is a top plan view of the ratchet drive mechanism of FIG. 1, showing part of the tool housing the ratchet in solid lines, partially broken away.

With reference to the drawings, 10 generally designates a ratchet drive mechanism constructed in accordance with and embodying the present invention. Ratchet drive 10 is contained in a hand tool, such as that shown for example in FIGS. 1, 8 and 9, and indicated generally at 12. Tool 12 as shown is of the power, hand-held type, and particularly is preferred to be of the pneumatic variety having an elongated housing 14 sized appropriately for manual operation and structured for conveniently and safely containing the working parts of the tool, including ratchet drive 10. Conceivably, however, ratchet drive 10 could be adapted for operational attachment to other known hand tools as well.

Generally, ratchet drive 10 includes a drive link 16 to which are pivotally connected a pair of pawls 18, 20, either of which pawls is in toothed contact with an annular drive gear 22, depending upon the selected position of a reversing cam 24, as will be explained in further detail hereafter. All of these elements and others to be described which are necessary for the proper connection and function of ratchet drive 10 are housed in the forward end of tool housing 14 (the end to the left in FIGS. 1, 8 and 9). For simplicity and clarity of the figures, not all parts are shown in all views.

More specifically, drive gear 22 is enclosed in the extreme forward end of tool housing 14 and is positioned such that teeth 26 which are formed longitudinally on the exterior circumferential surface of the drive gear are transverse in relation to the longitudinal axis of the tool. An integral and preferably square drive shaft 28 extends axially outwardly from the center of drive gear 22 to one side thereof and beyond the confines of housing 14, so as to be available to engage a socket (not shown) or other item for ratcheting turning thereof. A ball and spring assembly 30 of known variety facilitates the connection of square drive shaft 28 to the item to be turned.

Figure 6:
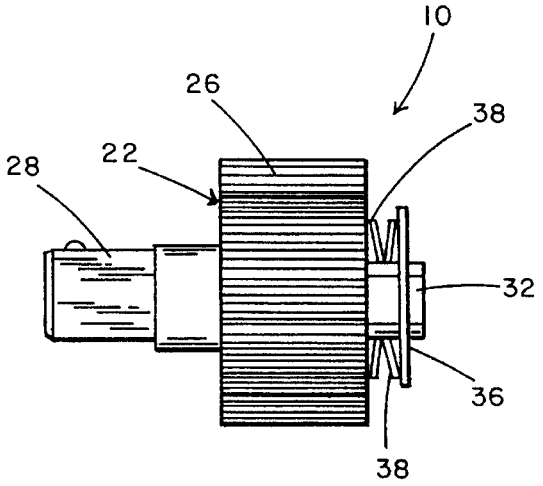
FIG. 6 is an end elevational view of the ratchet drive of FIG. 1, taken from the left side thereof.
Figure 7:
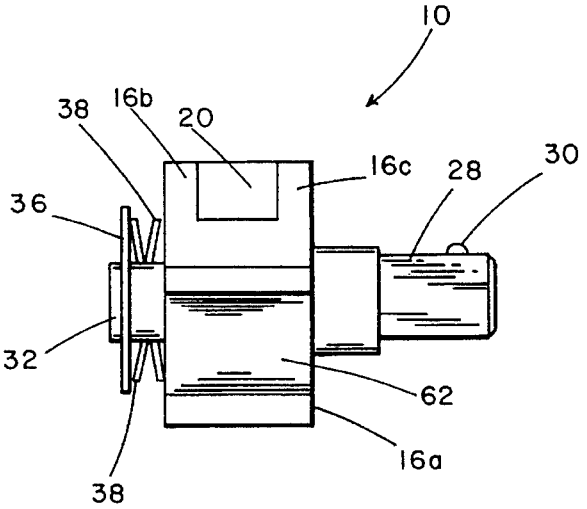
FIG. 7 is an end elevational view of the ratchet drive of FIG. 1 taken from the right side thereof.
Figure 9:
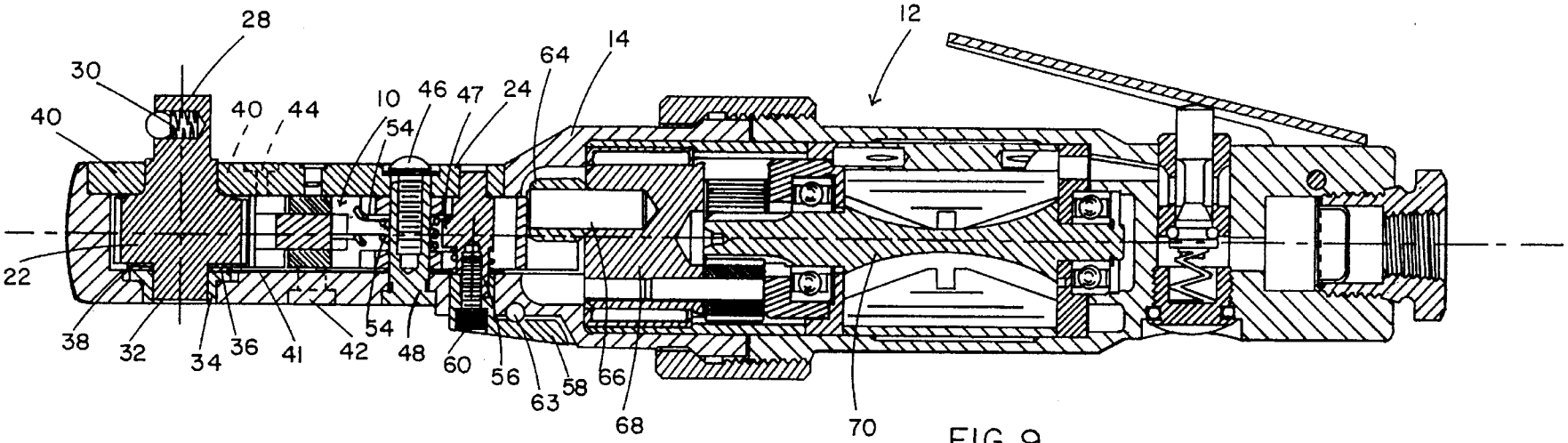
FIG. 9 is a sectional view taken on line 9—9 of FIG. 8.

On the other side of drive gear 22, directly opposite and coaxial to square drive shaft 28, an integral extension 32 (which may also be considered to be an inner end of the drive gear shaft) is formed and has desirably a "D" shape in cross section. Extension 32 is journaled in a flanged bushing 34 (shown in FIG. 9) which is seated in an appropriately sized transverse opening in housing 14. Directly interior of bushing 34 a friction washer 36 (also known as a wear or thrust washer) having a "D" opening corresponding to the cross section of extension 32 is disposed on extension 32 and separates bushing 34 from at least one and preferably two curved "Belleville" spring washers 38, as shown in FIGS. 6, 7 and 9. The combination of washers 38 and 36 serves to pre-load the drive gear axially and prevent oscillation thereof.

Drive gear 22 and other portions of mechanism 10, to be described, are retained in their positions within housing 14 by a preferably thick, metal cover plate 40 as shown in section in FIG. 9, and which fits sufficiently snugly to prevent debris from entering the housing yet does not inhibit operation of any moving parts of the mechanism. Cover plate 40 is secured to housing 14 preferably by at least two heavy screws, such as cap screws (not shown) which penetrate housing 14 at screw holes such as those indicated at 42 in FIGS. 8 and 9 and connect to plate 40 at openings such as that indicated in phantom at 44 in FIG. 9.

In the embodiment shown, also serving to connect plate 40 to housing 14 is a button-headed screw 46 which passes transversely through plate 40, perpendicularly with relation to the longitudinal axis of elongated tool 12 and securely seats longitudinally and coaxially within a pivot post 48 which passes transversely and rotatably through housing 14 on the side of tool 12 opposite cover plate 40. A conventional washer 47 desirably separates the head of screw 46 from the exterior surface of plate 40. Other means of securing cover plate 40 over ratchet mechanism 10 can certainly be conceived that will suffice.

FIGS. 1–5 and 8–10 illustrate the unique structure and interconnection of single arm pawl 18 and "split" or double arm pawl 20 with each other and with drive link or "yoke" 16. Single arm pawl 18 includes a head portion 18*a* which has a flat forwardly facing surface with a plurality of parallel teeth 18*b* formed thereon for selective movable interaction with the plurality of teeth 26 on the outer surface of drive gear 22.

Pawl head 18*a* is supported at the extreme forward end of a single pawl arm 18c which extends substantially longitudinally, rearwardly toward an elbow or angled portion 18*d* at which drive link 16 is pivotally connected by a pin 50. A second arm or straight section 18*e* extends from angled portion 18*d* rearwardly to a rearwardly directed pawl tip 18*f* which provides a contact point for cam 24.

Pawl 20 likewise has a head portion 20*a* with a forward facing flat surface bearing a plurality of parallel, transversely disposed teeth 20*b* which are sized and spaced appropriately for selective movable interaction with teeth 26 on the annular outer surface of drive gear 26. Paired, spaced-apart parallel pawl arms 20*c*, 20*c*' extend substantially longitudinally and rearwardly from opposed sides of pawl head 20*a* to a shared elbow or angled portion 20*d*, at which pawl 20 is pivotally connected by a pin 52 to drive link 16.

From angled portion 20*d* pawl 20 continues to extend substantially rearwardly via a second arm or straight section 20*d* which terminates in pawl tip 20*f*, a selective contact point with cam 24. Preferably, a thin, metal wear plate 41 is disposed within housing 14, between the inside wall surface thereof and the moving pawls 18, 20 and drive link 16 to protect the various parts and prolong the useful life thereof.

As seen in the figures, single pawl arm 18*c* extends rearwardly between paired, spaced-apart pawl arms 20*c*, 20*c*' so that as pawls 18, 20 move they interact with one another in scissors fashion, with the heads 18*a*, 20*a* opening, mouth-like toward the annular, toothed surface of drive gear 22. A torsion spring 54 (not shown in FIG. 10) is wrapped around pivot post 48 and the legs thereof extend forwardly, to slidably brace against the rearwardly and outwardly directed surfaces of pawls 18, 20 at or just rearwardly of the heads thereof to thereby bias pawl heads 18*a*, 20*a* toward the drive gear.

Figure 1:
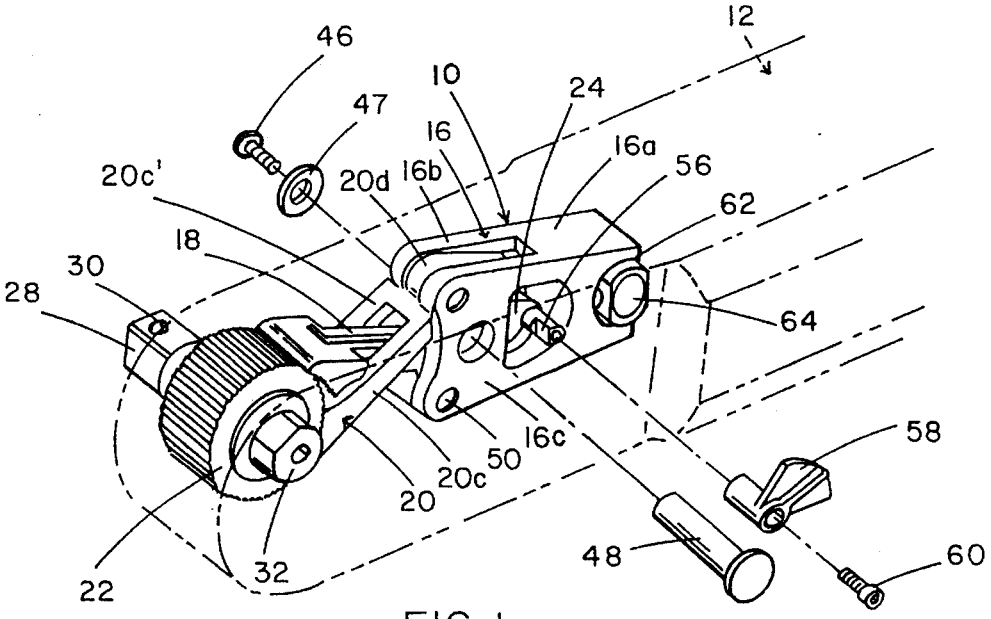
FIG. 1 is a perspective view of a ratchet drive mechanism constructed in accordance with the present invention, as disposed within a tool housing, shown in phantom.

Which of the pawls 18, 20 is in contact with the gear teeth 26 depends upon whether the tool is being operated in forward or reverse modes, as determined by the position of cam 24. Cam 24 had an outwardly extending stem 56 over which a reverse lever 58 is fitted and connected thereto, preferably by means of a hex-headed screw 60, as shown in FIGS. 1 and 9. Desirably, reverse lever 58 is provided with a ball and groove detent arrangement, for example as indicated at 63 in FIG. 9 to assure and maintain proper positioning of cam 24 for the desired mode of ratcheting operation.

Thus, if it desired to operate tool 12 to cause ratcheting rotation of drive gear 22 in one direction, cam lever 58 is set so that cam 24 is in contact with one pawl end 18*f* or 20*f* to prevent the corresponding pawl from moving pivotally as drive link 16 moves. The other pawl 18, 20 having a free end 20*f* unblocked by cam 24 can then extend forwardly so that the associated head is in contact with drive gear 22 and will necessarily move as the drive link moves to cause ratcheting rotation of the drive gear.

Drive link 16 is shown throughout the figures and consists generally of a solid body portion 16*a*, having integral paired parallel plates 16*b*, 16*c*. Plates 16*b*, 16*c* extend forwardly within tool 12 and are spaced apart from one another a sufficient distance to receive pawl elbows 18*d*, 20*d* therebetween, at the forwardly directed lower and upper (and preferably rounded) corners thereof, respectively, as seen from the perspective of FIG. 1. Appropriately sized and positioned, coaxially aligned apertures are formed transversely through plates 16*b*, 16*c* for receipt of pivot post 48, pins 50, 52 and cam 24.

Figure 2:
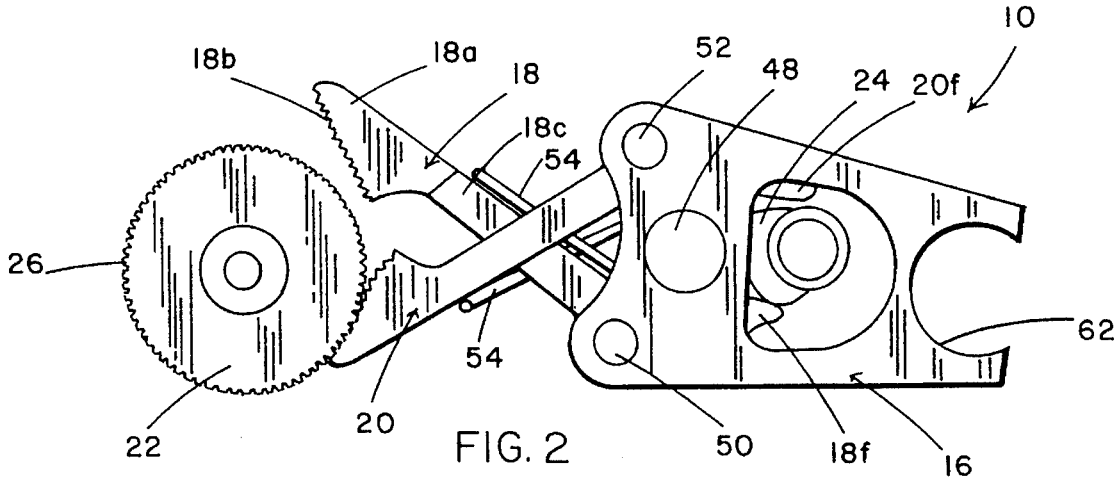
FIG. 2 is a side elevational view of the ratchet drive of FIG. 1 positioned for rotational operation in one direction.
Figure 3:
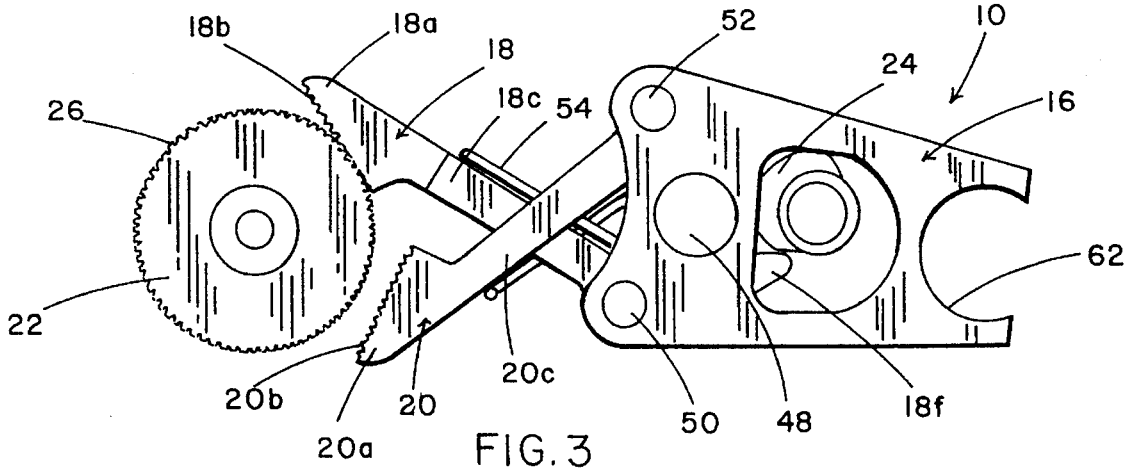
FIG. 3 is a side elevational view of the ratchet drive of FIG. 1, positioned for rotational operation in the direction opposite that of FIG. 2.
Figure 4:
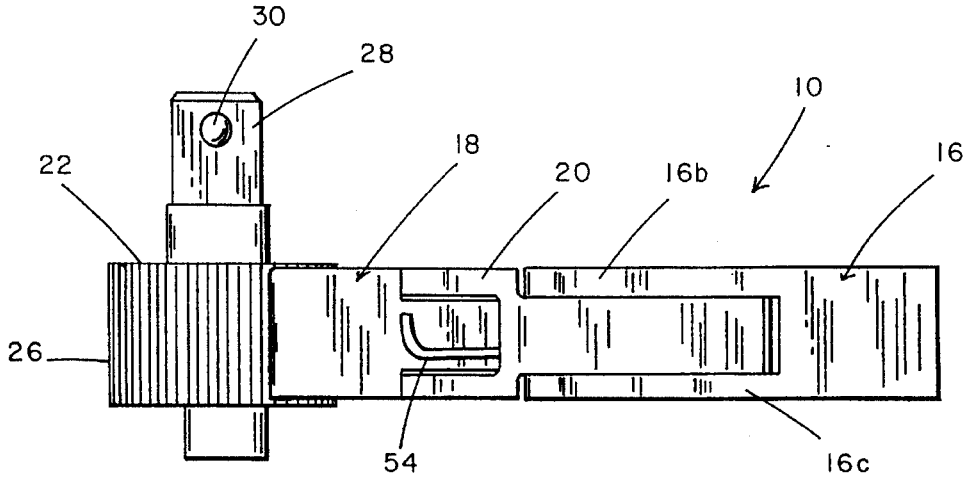
FIG. 4 is a top elevational view of the ratchet drive of FIG. 1.
Figure 5:
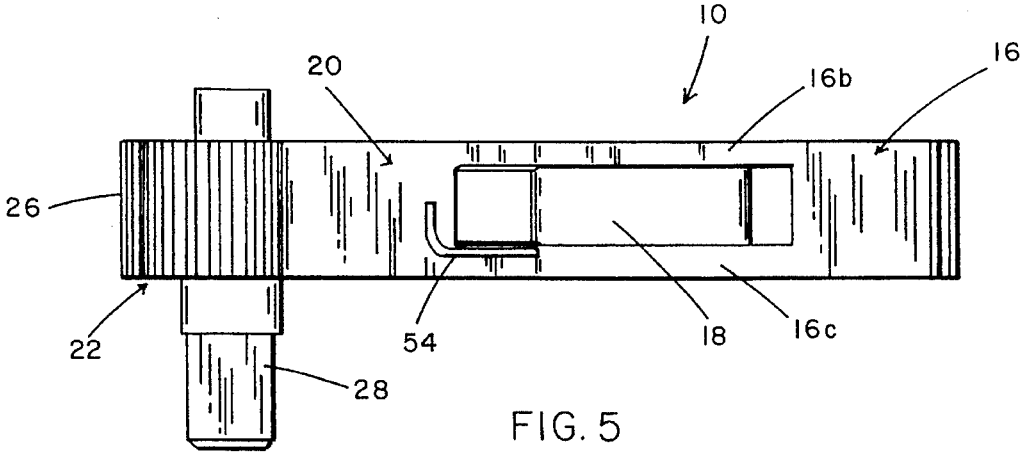
FIG. 5 is a bottom elevational view of the ratchet drive of FIG. 1.

As seen in FIGS. 1–3, drive link 16 has a transverse, arcuately shaped opening 62 in its rearwardly directed body 16*a*. Opening 62 receives a drive bushing 64 (FIGS. 1, 8 and 9) which is sized and shaped for smooth rotational movement within the opening or groove 62. Drive bushing 64 receives a crank pin 66 by which it is connected to the rotatable planet carrier 68 of tool 12 longitudinally, but offset from the longitudinal center thereof. Bushing 64 is thus caused to move by the carrier 68 with, in the preferred case, pneumatically powered movement of the tool rotor 70 in the usual manner.

Thus, as drive bushing 64 rotates around the longitudinal axis of tool 12 it pushes against the inside curved wall of opening 62 and thus forces drive link 16 rapidly back and forth. Drive link 16 is transversely and rotatably penetrated by pivot pin 48, previously discussed, at a point forwardly of cam 24 and between and rearwardly of pawl elbows 18*d*, 29*d*. Drive link 16 is thus movably connected within housing 14 so that it may rock to and fro about pin 48 and cause pawls 18, 20 to move with it about their connections at pins 50, 52, respectively, at speeds of up to approximately 4,000 to 5,000 rmp when the tool motor is operating in the range of 20,000 to 25,000 rpm. However, due to the structure and position of reverse cam 24 between pawl ends 18*f*, 20*f*, at any given time, only one of the pawls 18, 20 can be in contact with drive gear 22 and force movement thereof with the rocking of drive link 16. This in turn causes operational rotation of square drive shaft 28 at speeds in the range of approximately 190 to about 225 rpm.

Figure 10:
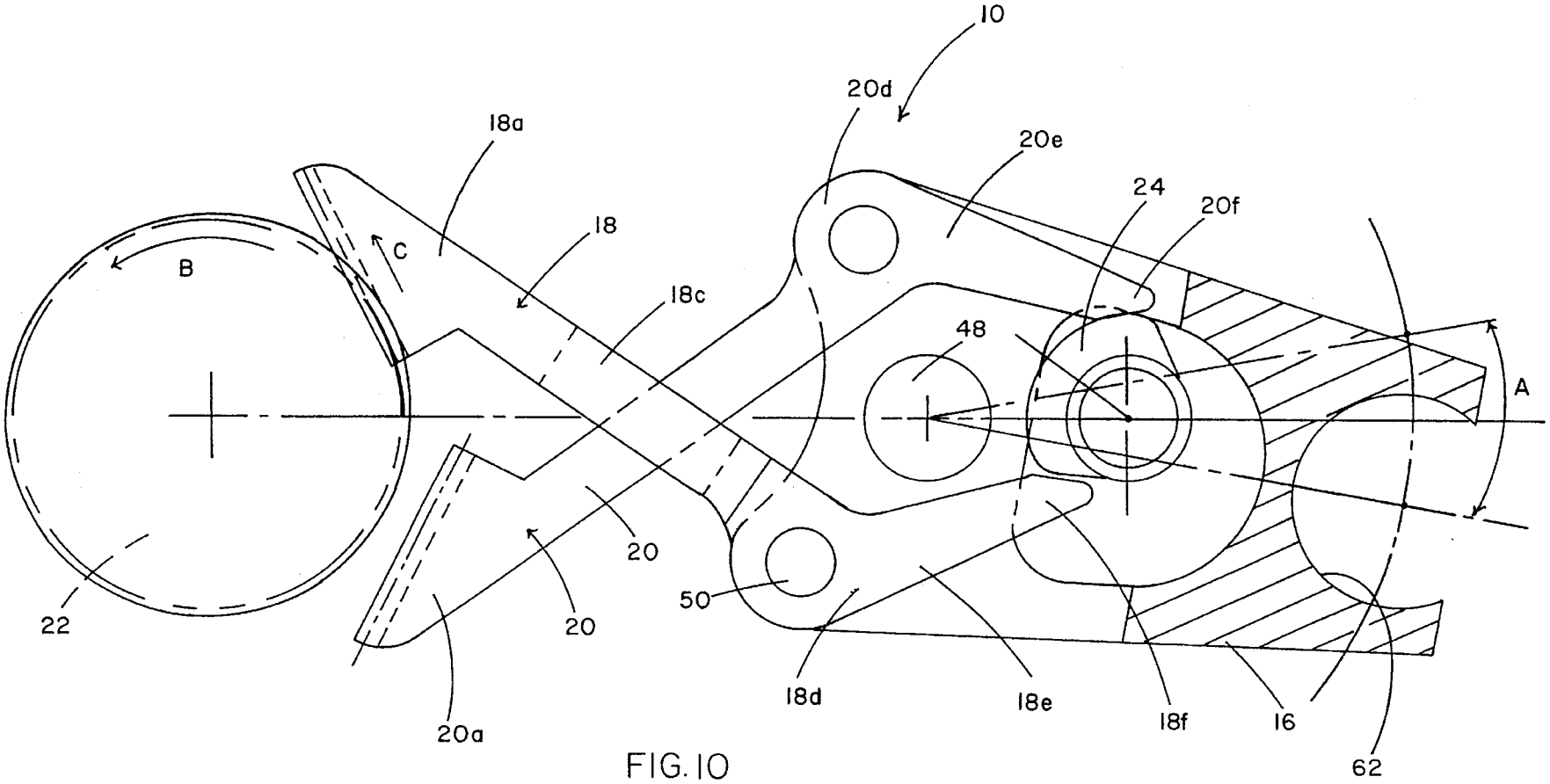
FIG. 10 is an enlarged schematic representation of the ratchet drive mechanism of FIG. 1 for illustration of the operation thereof.

With reference to the schematic view shown in FIG. 10, the above action is explained more specifically hereafter. Drive link 16 pivots about the axis of pivot pin 48 and is driven by the crankshaft or pin 66 through a 20° angle of oscillation, as indicated at A, 10° to each side of the central longitudinal axis of ratchet drive mechanism 10. Drive link 16 drives pawls 18, 20 a distance equivalent to two and one third teeth 26 of drive gear 22. Reverse cam 24 prevents the non-working pawl from engaging gear 22 while the other working pawl is driving and is locked by means of detented lever 58 in the chosen direction.

Thus, in FIG. 10, cam 24 is in contact with the rearwardly directed end 20*f* of pawl 20, resulting in pawl 20 being locked so that forwardly directed head 20*a* is not in contact with drive gear 22. With cam 24 so positioned it is not in contact with rearwardly directed end 18*f* of pawl 18, so that pawl 18 can pivot freely on pin 50 in response to the oscillating action of drive link 16. As pawl 18 so pivots, teeth 18*b* on forwardly directed head 18*a* engage teeth 26 on drive gear 22. The gear is then caused to rotate ratchetwise in the direction of arrow B (counterclockwise as seen in FIG. 10) in response to movement by pawl head 18*a* in the direction shown by arrow C, as caused by drive link 16 oscillation.

When structured as shown and described, ratchet drive 10 has among its advantages the feature of being reversible with use of only one hand. Accordingly, in use, by merely throwing lever 58 to the opposite position from that being already used the ratchet drive gear 22 can be made to rotate in the opposite direction, clockwise or counterclockwise.

Moreover, this reversal of ratcheting direction is readily accomplished even while tool 10 is in operation, because it is not necessary to reverse the direction of the tool motor or other tool parts. Only the direction of cam 24 is changed to thereby alter which pawl is in operative contact with drive gear 22, thus driving the gear in the opposite direction.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A ratchet drive mechanism substantially completely enclosed within the housing of a hand tool, the ratchet drive mechanism comprising:

a) a drive link having a first end and a second end, the first end being disposed rearwardly within the tool housing and being adapted to engage a movement-imparting element of the hand tool and the second end being disposed forwardly within the tool housing and being adapted to movably engage at least one pawl;

b) at least one pawl having a first end and a second end and extending continuously therebetween and having an angle substantially centrally along the length thereof to form an elbow, the at least one pawl being movably connected to the second end of the drive link at the elbow of the at least one pawl;

c) a drive gear having a drive shaft extending axially therefrom, the drive gear being mounted within a forward end of the housing of the hand tool with the drive shaft disposed transversely relative to a longitudinal axis of the hand tool and extending beyond the confines of the tool housing for interengagement of an item to be turned;

d) wherein the at least one pawl comprises a first pawl and a second pawl disposed in crossed relation to one another, the first pawl having a forked shape including two spaced-apart parallel arms, and the second pawl having a single elongated member which extends between the two tines of the first pawl, so that the first pawl and the second pawl can move in relation to one another in scissors-like fashion.

2. The mechanism of claim 1, wherein the first pawl and the second pawl each terminate in a head which extends toward and selectively interengages the drive gear.

3. The mechanism of claim 2, wherein the second end of the first pawl and the second end of the second pawl each have a plurality of teeth formed transversely thereon, and the drive gear has a plurality of teeth formed around the external surface thereof, disposed transversely to the longitudinal axis of the hand tool, the plurality of teeth on the drive gear and on the heads of the first and second pawls being sized and spaced appropriately so as to interengage with one another when either of the first pawl and the second pawl is selectively placed in operational contact with the drive gear.

4. The mechanism of claim 3, wherein the respective numbers of teeth on the first and second pawls and the drive gear and the sizes of spacing of the teeth are such that at least two teeth of the drive gear are engaged during turning of the drive gear.

5. The mechanism of claim 1, and further comprising a cam pivotally mounted between the first end of the first pawl and the first end of the second pawl to thereby effect locking of either one or the other of the first pawl and the second pawl out of operative position with the drive gear so that as the drive link oscillates the other of the first pawl and the second pawl which is not locked out of contact with the drive gear can engage the drive gear and cause ratcheting rotation thereof as the drive link moves in response to motion by the movement-imparting element of the hand tool.

6. The mechanism of claim 5, and further comprising a lever operatively connected to the cam, to thereby cause the ratchet drive mechanism to reverse ratcheting direction.

7. The mechanism of claim 1, wherein the movement imparting element of the hand tool is a crank pin, and further comprising a drive bushing disposed in the arcuate opening at the first end of the drive link for interconnecting with the crank pin of the hand tool for rotation thereby, to in turn cause movement of the drive link and movement of either of the first pawl and the second pawl, whichever is in interengagement with the drive gear, resulting in ratcheting rotation of the drive gear.

8. The mechanism of claim 1, wherein a thin metal plate is interposed between the inside of the tool housing and the mechanism to decrease wear caused by movement of the mechanism against and inner surface of the housing, and further comprising a friction washer seated within the housing and receiving an inner end of the drive gear shaft.

9. The mechanism of claim 8, and still further comprising at least one Belleville spring mounted on the inner end of the drive gear shaft between the drive gear and the friction washer.

10. The mechanism of claim 1, and further comprising a post which transversely penetrates the hand tool and has the drive link of the mechanism pivotally mounted thereon within the housing to thereby cause the drive link to oscillate about the post under encouragement from the movement imparting element of the hand tool.

11. The mechanism of claim 1, and further comprising a spring in contact with the first pawl and the second pawl to thereby bias the second end of the first pawl and the second end of the second pawl toward each other and toward the drive gear.

12. The mechanism of claim 11, wherein the first pawl and the second pawl each have an exterior surface which faces outwardly and toward the first end of the drive link, and further wherein the spring which biases the first pawl and the second pawl toward each other is a torsion spring anchored on the post and having first and second arms, the first arm bearing forwardly against the exterior surface of the first pawl and the second arm bearing forwardly against the exterior surface of the second pawl to thereby bias the forwardly directed first end of the first pawl and the forwardly directed end of the second pawl toward one another and toward the drive gear disposed therebetween within the tool housing.

13. The mechanism of claim 1, wherein the drive link is yoke-shaped and has a body portion at the first end and two spaced-apart parallel plates at the second end, the two parallel plates being integral with and extending forwardly in the tool housing from the body portion, the two parallel plates each having two opposed, forwardly directed corner areas each defining a through-hole positioned so that the through-holes of the corner areas of one plate are coaxial with the through-holes of corresponding corner areas of the other plate.

14. The mechanism of claim 13, and including a first pin and a second pin, and wherein the first pawl and the second pawl are movably connected to the drive link between the spaced-apart parallel plates of the drive link at the angles formed substantially centrally along corresponding lengths of the first pawl and the second pawl to the forwardly directed opposed corners thereof at the through-holes by the first pin and the second pin which pass through corresponding opposed drive link corners and angles of the first pawl and the second pawl to thereby permit the first pawl and the second pawl to pivot in relation to the drive link.

15. The mechanism of claim 1, wherein a metal plate covers the mechanism and is secured to the housing so that the mechanism is substantially completely and securely enclosed within the housing of the tool.

16. The mechanism of claim 1, and further including a drive bushing disposed in the arcuate opening at the first end of the drive link for interconnecting with a crank pin of the hand tool for rotation thereby, to in turn cause oscillation of the drive link and oscillation of the first pawl and the second pawl which alternatingly interengage the drive gear, resulting in ratcheting rotation of the drive gear.

17. A ratchet drive mechanism substantially entirely enclosed within the housing of a hand tool, the ratchet drive mechanism comprising:

a) a yoke-shaped drive link having a first end and a second end, the first end being disposed rearwardly in the tool housing and being adapted to engage a movement-imparting element of the hand tool, and the second end being disposed forwardly in the tool housing and being adapted to movably engage a first pawl and a second pawl;

b) a first pawl and a second pawl each having a first end and a second end and extending continuously therebetween and having an angle formed substantially centrally along corresponding lengths thereof, the first pawl and the second pawl each being movably connected to the second end of the drive link at the respective angles formed substantially centrally along corresponding lengths of the first pawl and the second pawl, and the second end of the first pawl and the second end of the second pawl each having a plurality of teeth formed transversely thereon;

c) a cam pivotally mounted between the first end of the first pawl and the first end of the second pawl to thereby cause the ratchet drive mechanism to reverse ratcheting direction;

d) a lever operatively connected to the cam to permit selection by a tool user of the cam position in order to determine in which of a forward and a reverse ratcheting direction the tool is operated;

e) a drive gear having a drive shaft extending axially therefrom, the drive gear being mounted within the housing of the hand tool with the drive shaft disposed transversely relative to a longitudinal axis of the hand tool and extending beyond the confines of the tool housing for interengagement of an item to be turned, and the drive gear having a plurality of teeth formed around the external surface thereof, disposed transversely to the longitudinal axis of the hand tool, the plurality of teeth being sized and spaced appropriately so as to intermesh with the plurality of teeth on the second ends of the first pawl and the second pawl and a square drive shaft extending from the drive gear beyond the housing for connecting to a device to be rotated by the hand tool;

f) a drive bushing disposed in the arcuate opening at the first end of the drive link for interconnecting with a crank pin of the hand tool for rotation thereby, to in turn cause oscillation of the drive link and oscillation of the first pawl and the second pawl which alternatingly interengage the drive gear, resulting in ratcheting rotation of the drive gear.

18. A power hand tool having a housing and a ratchet drive mechanism, wherein the improvement comprises the ratchet drive mechanism being substantially completely enclosed within the housing of a hand tool, and further comprising:

a) a drive link having a first end and a second end, the first end being disposed rearwardly within the tool housing and being adapted to engage a movement-imparting element of the hand tool and the second end being disposed forwardly within the tool housing and being adapted to movably engage at least one pawl;

b) at least one pawl having a first end and a second end and extending continuously therebetween and having an angle substantially centrally along the length thereof to form an elbow, the at least one pawl being movably connected to the second end of the drive link at the elbow of the at least one pawl;

c) a drive gear having a drive shaft extending axially therefrom, the drive gear being mounted within a forward end of the housing of the hand tool with the drive shaft disposed transversely relative to a longitudinal axis of the hand tool and extending beyond the confines of the tool housing for interengagement of an item to be turned;

d) wherein the at least one pawl comprises a first pawl and a second pawl disposed in crossed relation to one another, the first pawl having a forked shape including two spaced-apart parallel arms, and the second pawl having a single elongated member which extends between the two tines of the first pawl, so that the first pawl and the second pawl can move in relation to one another in scissors-like fashion.

* * * * *